US005832699A

United States Patent [19]

Zobel

[11] Patent Number: 5,832,699

[45] Date of Patent: Nov. 10, 1998

[54] PACKAGING METHOD

[75] Inventor: Michael George Reinhardt Zobel, Bridgwater, England

[73] Assignee: Sidlaw Flexible Packaging Limited, London, England

[21] Appl. No.: 41,190

[22] Filed: Apr. 1, 1993

Related U.S. Application Data

[63] Continuation of Ser. No. 623,675, Dec. 6, 1990, abandoned, which is a continuation of Ser. No. 377,071, Jul. 10, 1989, abandoned.

[30] Foreign Application Priority Data

Jul. 15, 1988 [GB] United Kingdom ..... 8816951

[51] Int. Cl.[6] ..... B65B 11/00; B65B 31/00

[52] U.S. Cl. ..... 53/461; 53/432; 426/415; 426/419

[58] Field of Search ..... 53/141, 396, 432, 53/449, 469, 461; 383/100, 102, 103; 426/410, 415, 419

[56] References Cited

U.S. PATENT DOCUMENTS

| | | | |
|---|---|---|---|
| 3,043,071 | 7/1962 | Sadell | 53/141 |
| 3,224,898 | 12/1965 | Spencer . | |
| 3,264,167 | 8/1966 | Sands . | |
| 3,271,560 | 9/1966 | Schott, Jr. . | |
| 3,334,803 | 8/1967 | Abbey . | |
| 3,546,327 | 12/1970 | Ruda . | |
| 3,657,610 | 4/1987 | Komatsu et al. . | |
| 4,735,843 | 4/1988 | Noda . | |
| 4,876,146 | 10/1989 | Isaka et al. | 428/347 |

FOREIGN PATENT DOCUMENTS

| | | | |
|---|---|---|---|
| 0039115 | 11/1981 | European Pat. Off. . | |
| 243965 | 11/1987 | European Pat. Off. . | |
| 54-40793 | 3/1978 | Japan | B65D 85/52 |
| 53-51096 | 5/1978 | Japan . | |
| 62-235086 | 10/1987 | Japan . | |
| 2068991 | 8/1981 | United Kingdom . | |
| 2179025 | 8/1985 | United Kingdom . | |

OTHER PUBLICATIONS

Briones et al., *International Journal of Food Science and Technology* (1992), 27, 493–505.

*Primary Examiner*—Linda Johnson
*Attorney, Agent, or Firm*—Bacon & Thomas

[57] ABSTRACT

The invention provides methods of packaging plant materials. The plant materials are packaged in a perforate polymeric film, the film being of a polymer having a water vapor transmission rate and an oxygen transmission rate which improve the shelf lives of the packaged materials. The film is selected so that the water vapor transmission rate is substantially that inherent to the film, and the oxygen transmission rate is controlled by the size and/or frequency of perforations in the film. Typically the perforations will have a mean diameter of not more than 100 microns, and preferably from 40 to 60 microns. The frequency of perforations will usually be not more than 1000 per square meter, although at least 10 per square meter will usually be required.

9 Claims, No Drawings

PACKAGING METHOD

This application is a continuation of application Ser. No. 07/623,675 filed Dec. 6, 1990, now abandoned, which is a continuation of application Ser. No. 07/377,071 filed Jul. 10, 1989, now abandoned.

This invention concerns the storage or packaging of plant materials.

During storage, plant materials continue to respire even when the materials have been removed from the plant on which they were growing or when the plant material has been dug out of the ground. Thus fruit and vegetables, for example, continue to place demands on the surrounding atmosphere during storage, and deterioration of the quality of the plant materials occurs through water loss and surrounding levels of oxygen and carbon dioxide which do not favour their remaining fresh.

The freshness of fruit and vegetables can be prolonged by packaging, and this can have the added advantage of reducing damage when the fresh produce is displayed on a supermarket shelf. However, there are problems with the use of many packaging materials as the atmosphere within the package changes as respiration proceeds. This can be a particular problem with plant materials which undergo a climacteric stage during ripening, when a sharp rise in the rate of respiration occurs. Thus, while polymeric films, e.g. polyolefin films, can improve the shelf life of fruit and vegetables, a point can come during their storage when deterioration is accelerated by the changes in the atmosphere within the package.

Various proposals have been made for overcoming the problems with storing plant materials in packages made from polymeric films. British Patent Specifications 1106265 and 1134667, for example, describe control of the atmosphere within a package so that the oxygen content is less than that of normal air while the carbon dioxide content is greater than that of normal air, this being effected by the use of imperforate polyethylene sheet of a thickness that it is permeable to oxygen and carbon dioxide and of an area sufficient to allow the sealed-in produce to establish and maintain a controlled atmosphere within the package. Although oxygen and carbon dioxide levels are controlled by this method, the water content of the atmosphere is not and this can lead to undesirable water levels which can increase deterioration of the packaged materials.

Films with very high water permeability are proposed in Japanese Patent Publication 62.148247, 50 to 300 holes per square centimeter being made in the film, each hole being from 50 to 300 microns in diameter. These films are proposed for wrapping cut flowers where the water vapour permeability has to be sufficient to remove condensed water droplets.

Other proposals include the use of gas and water-vapour impermeable films which have permeable windows let into them, the windows being made of more permeable materials. Alternatively, composite containers have been proposed in which one side of the container is made from an impervious plastics film and another side is made from a microporous film.

According to the present invention there is provided a method of packaging plant material, the method comprising packaging the plant material in a perforate polymeric film, the film being of a polymer having a water vapour transmission rate and an oxygen transmission rate which improve the shelf life of the packaged plant material, the water vapour transmission rate being substantially that inherent to the film and the oxygen transmission rate being controlled by the size and/or frequency of the perforations in the film.

The method of the present invention enables a wide variety of plant materials to be given particularly good shelf lives without the use of complicated or costly windows or combinations of films of different permeability. In particular, the respiration rate of the packaged plant materials can be slowed down, but undesirable anaerobic conditions can be avoided. Furthermore, the film can be selected so that oxygen and carbon dioxide transmission rates are substantially equal, and these can surprisingly be selected independently of the water vapour transmission rate of the film.

Although the present invention finds particular value in the packaging of plant materials separated from the growing plant, it can also be used for the packaging of intact plants.

The water vapour permeability of the films used in accordance with the present invention can be selected by the type of polymer used for the film. Examples of polymers which can be used include regenerated cellulose, homo and copolymers of polyolefins, e.g. with vinyl acetate or methyl acrylate, polyesters, polyamides and polycarbonates. The films can furthermore be multilayer structures, for example laminates, and they can include one or more layers, e.g. a heat sealable layer. Films of regenerated cellulose can be used to achieve water vapour permeability over a wide range, typically up to 800 g $m^{-2}$ $day^{-1}$ measured at 25° C. and 75 percent relative humidity for a film 24 microns thick. Lower permeabilities can be achieved by the use of a thicker film, but it is generally preferred to apply a coating to the film when it is desired to reduce its inherent permeability to water vapour. Suitable materials for the purpose are known in the art. Thus water vapour permeabilities of 100–800 g $m^{-2}$ $day^{-1}$ can be achieved, and if desired lower values, e.g. down to 80 g $m^{-2}$ $day^{-1}$, or even lower, e.g. as little as 10 g $m^{-2}$ $day^{-1}$ can be achieved. When a coating is present, the permeability will usually be less than 500 g $m^{-2}$ $day^{-1}$.

Polyolefin films can also be used in accordance with the present invention, the inherent water vapour permeability of films of such materials tending to be substantially less than that of uncoated regenerated cellulose films of the same thickness. Polyethylene films 30 microns thick typically have water vapour permeabilities of about 4 g $m^{-2}$ $day^{-1}$, while polypropylene films of the same thickness typically have water vapour permeabilities of 1–2 g $m^{-2}$ $day^{-1}$.

The water vapour permeability of the film will be selected to suit the respiration requirements of the plant material to be packaged, and therefore there are no overall preferences for water vapour permeability other than that the permeability be selected to optimise the storage life of the packaged plant material.

The oxygen permeability of the films used in accordance with the present invention will usually be not more than 200000 $cm^3$ $m^{-2}$ $day^{-1}$ $atmosphere^{-1}$ as measured at 25° C. and 75 percent relative humidity. As with water vapour permeability, different plant materials require films with different oxygen permeabilities, and permeabilities of not more than 100000, e.g. less than 50000 $cm^3$ $m^{-2}$ $day^{-1}$ $atmosphere^{-1}$ are often preferred. Lower oxygen permeabilities still can also be achieved, for example less than 10000 $cm^3$ $m^{-2}$ $day^{-1}$ $atmosphere^{-1}$. The oxygen permeability will, however, be greater than that inherent for the material of the film, and typically it should be at least 900 $cm^3$ $m^{-2}$ $day^{-1}$ $atmosphere^{-1}$ greater than that of the material of the film. This usually means at least 3500 $cm^3$ $m^{-2}$ $day^{-1}$ $atmosphere^{-1}$.

The oxygen permeability of films is achieved by perforations in the film. The size of the perforations affects the oxygen permeability of the film, and they are preferably up to 100 microns and they can be as low as 20 microns or less.

A more preferred range is 40 to 60 microns and, advantageously they are of about 50 microns mean diameter. If the perforations are too large, control of oxygen permeability is not possible, and if the perforations are too small large number of holes are required which in particular adds to the cost of the film. Typically it is preferred to have up to 1000 perforations in the film per square meter of film surface, but as few as 10 perforations or even less can be used. This is very significantly lower than the frequency of perforations in the films proposed in Japanese Patent Publication 62.148247 which proposes 50 to 300 holes per square centimeter, i.e. at least five hundred times fewer perforations for the same area of film. As will be appreciated, the size and number of perforations in films in accordance with the invention will be selected according to the plant material to be packaged. However, there should be sufficient perforations in the film that each package of plant material has at least one perforation. This usually requires at least 50 perforations per square meter. Usually the film will have fewer than 500 perforations per square meter, and typically from 100 to 300 per square meter.

It should be noted that the perforations in the films used in accordance with the invention are very small, and in general the films are clear despite these perforations.

The holes or perforations in the films can be produced by known methods. It is, however, unlikely that they will be sufficiently small to achieve the desired oxygen permeability if mechanical puncturing methods are used, and the preferred methods are electrical discharge and optical means, e.g. using a laser.

In most applications, it will be necessary to be able to heat seal films of the present invention, in particular to ensure that the oxygen permeability depends on the perforations in the film rather than leaks in the package. Various heat sealable layers can therefore be present on films of the present invention, and as will be appreciated these will affect the inherent water vapour permeability of the films. Of course, the film itself may be of a heat sealable material.

As will be appreciated by those skilled in the art, any heat sealable layer or other layer should not obscure the perforations in the film, and the perforations will therefore usually be made in a film already having such layers. These layers, which can be selected from those known in the art, can be formed in known manner, for example by co-extrusion or by coating.

In packaging plant materials, the film will be selected to meet the requirements of the material to be packaged, both in terms of water vapour permeability (i.e. the type and thickness of polymer used for the film) and oxygen permeability (i.e. the size and frequency of perforations, these also differing for the same material under different temperature conditions.) Obviously when very small numbers of perforations are used, e.g. about 10 per square meter, the amount of film used for an individual pack should be such as to include at least one perforation in the surface of the film so that oxygen can pass between the interior of the pack and the atmosphere outside.

Various types of fruits, vegetables, herbs and flowers have shown particularly good shelf lives when packaged using a method of the present invention. Thus broccoli, carrots, mushrooms and tomatoes, which represent a wide variety of plant materials in terms of requirements for oxygen, carbon dioxide and water vapour during respiration, have all shown extended shelf lives when compared with those packed in hitherto proposed polymeric packaging films.

The following Examples are given by way of illustration only. All parts are by weight and all temperatures are in °C. unless stated otherwise.

EXAMPLE 1

After discarding any showing signs of damage, carrots were washed, placed for 1 minute in chilled water containing 25 ppm of chlorine, and then rinsed with cold water. The carrots were allowed to dry, and packs were prepared by heat sealing them in a variety of films, each pack having internal dimensions of 20 cm×18 cm and containing approximately 0.35 kg of carrots. A similar quantity of carrots on an open tray without any wrapping film acted as a control. The samples were all stored at 20° C. and 50 percent relative humidity.

The films used were as follows:

(A)—heat sealable oriented polypropylene 25 microns thick and having 100 holes per square meter, the mean diameter of the holes being about 50 microns (B)—as film (A) but with 68 holes per square meter (C)—as film (A) but with 34 holes per square meter (D)—as film (A) but without any holes (E)—imperforate polyethylene cling film 25 microns thick (F)—imperforate polyvinyl chloride stretch wrap film 25 microns thick All of the packs having a film over the carrots had a much improved shelf life compared with the unwrapped control. The packs had mould free shelf lives of at least seven days, the unwrapped carrots becoming dried, shrivelled and unacceptable after three days. The packs wrapped with the imperforate films (D), (E) and (F) either became anaerobic within three days or were becoming so by 10 days. The carrots wrapped in film (B) were particularly good, those wrapped in films (A) and (C) being somewhat less so but still significantly better than those wrapped in the other films.

Water losses from all of the packaged carrots were acceptable in all cases at less than 1% by weight after 10 days.

EXAMPLE 2

The procedure of Example 1 was repeated for tomatoes except that they were packed in trays of six after washing and then drying for one hour. The calices were not removed.

Each tray was wrapped in one of the films (A) and (C)–(F) of Example 1, and a further tray was left unwrapped as a control.

The unwrapped tomatoes became very soft and mouldy after four days, and those wrapped in film (F) became mouldy after three days. Film (A), with 100 holes per square meter, led to widespread mould after seven days, the tomatoes having become soft after four days. However, tomatoes packed in film (C) remaince firm even after six days.

EXAMPLE 3

Packs of unwashed calabrese were prepared by wrapping 150 g of the calabrese on trays 025 m×0.185 m (area 0.0925 $m^2$), the films being:

(G)—25 micron thick heat sealable oriented polypropylene film (H)—film (G) with 21 holes over pack area (I)—film (G) with 7 holes over pack area For comparison purposes, 150 g samples of calabrese were packed in 25 microns thick polyvinyl chloride cling film or simply left unwrapped.

The unwrapped pack was very limp and showed browning after two days at 20° C. and 50 percent relative humidity.

Under the same conditions, the calabrese packed in the polyvinyl chloride cling film showed yellowing after two days whereas the perforated films of the present invention did not show adverse signs until nearly six days. After three days, the calabrese packed in the unperforated polypropylene film showed dry ends and it was limper than that in the perforated film. At 4° C., calabrese stored in films of the present invention were still very good and fresh after 17 days and of better appearance than any of the samples packed using the other films.

EXAMPLE 4

Using the procedure of Example 3, 200 g of unwashed mushrooms were packed in a variety of films as follows:

(J)—unperforated heat sealable regenerated cellulose film 25 microns thick and having a water vapour permeability of 80 g $m^{-2}$ $day^{-1}$—pack size 0.25 m×0.185 m (area 0.0925 $m^2$)

(K)—film (J) with 53 holes over pack area—pack size 0.175 m×0.125 m (area 0.0875 $m^2$)

(L)—as film (K) but with 25 holes over same pack area (M)—as film (K) but with 12 holes over same pack area Comparison tests were also carried out using 25 micron thick polyvinyl chloride cling film with 200 g of mushrooms on a 0.175 m×0.125 m tray and with the same amount of mushrooms unwrapped, the packs being stored at 20° C. and 50 percent relative humidity.

The unwrapped mushrooms were unacceptable after two days, as were those packed in the cling film and in film (J). The mushrooms packed in film (K) were still acceptable approaching six days, whereas those packed in films (L) and (M) were showing significant signs of deterioration after three days.

A similar series of tests at 4° C. using of the present invention based on the same regenerated cellulose film but with 12, 25 and 50 holes respectively over the back area showed very good results at up to 20 days whereas the unperforated film and the cling film led to an unacceptable product in some cases mould formation after only two days.

I claim:

1. A method of packaging plant material in a perforate polymeric film comprising selecting a perforate polymeric film having from 10 to 1000 perforations per square meter, said perforations having a mean diameter of 20 to 100 microns, said film having a water vapour transmission rate which is substantially the same as the rate for the film without perforations and having an oxygen transmission rate which is controlled by the size and/or frequency of the perforations in the film, placing the plant material in the perforate polymeric film and sealing the film to form a package containing the plant material, such that improved shelf life of the packaged plant material is obtained.

2. A method according to claim 1, wherein the perforate polymeric film comprises regenerated cellulose or a polyolefin.

3. A method according to claim 1, wherein the film comprises a polyamide, a polyester or a polycarbonate each with a heat sealable layer thereon.

4. A method according to claim 1, wherein the perforations have a mean diameter of 40 to 60 microns.

5. A method according to claim 4, wherein the perforations have a mean diameter of about 50 microns.

6. A method according to claim 1, wherein the film has a water vapour transmission rate of not more than 800 g $m^{-2}$ $day^{-1}$ $atmosphere^{-1}$, measured at 25° C. and 75 percent relative humidity.

7. A method according to claim 1, wherein the film has an oxygen permeability of not more than 200000 $cm^3$ $m^{-2}$ $day^{-1}$, measured at 25° C. and 75 percent relative humidity.

8. A method according to claim 1, wherein the plant material comprises fruit, vegetables, herbs or cut flowers.

9. A method as claimed in claim 1 in which the perforate polymeric film has at least 50 perforations/$m^2$.

* * * * *